US006095265A

United States Patent [19]

Alsup

[11] Patent Number: 6,095,265

[45] Date of Patent: Aug. 1, 2000

[54] IMPREGNATED DRILL BITS WITH ADAPTIVE MATRIX

[75] Inventor: Shelton W. Alsup, Houston, Tex.

[73] Assignee: Smith International, Inc., Houston, Tex.

[21] Appl. No.: 09/087,092

[22] Filed: May 29, 1998

Related U.S. Application Data

[60] Provisional application No. 60/055,861, Aug. 15, 1997.

[51] Int. Cl.[7] ..... E21B 10/46

[52] U.S. Cl. ..... 175/379; 175/434

[58] Field of Search ..... 175/379, 420.1, 175/420.2, 426, 434

[56] References Cited

U.S. PATENT DOCUMENTS 4,128,136 12/1978 Generoux .
4,512,426 4/1985 Bidegaray .
5,282,513 2/1994 Jones ..... 175/434
5,435,403 7/1995 Tibbitts .

FOREIGN PATENT DOCUMENTS 2081347 2/1982 United Kingdom .
2298668A 9/1996 United Kingdom .
2300208A 10/1996 United Kingdom .

*Primary Examiner*—William Neuder
*Attorney, Agent, or Firm*—Wesley T. Noah

[57] ABSTRACT

The present invention provides a diamond impregnated bit with an adaptive matrix in the ribs. The ribs have at least two different areas of metal-matrix composite impregnated with diamonds with different wear resistance such that during boring of formation, the areas will wear at different rates and provide fluid flow spaces across the surface of the ribs.

16 Claims, 10 Drawing Sheets

IMPREGNATED DRILL BITS WITH ADAPTIVE MATRIX

CROSS-REFERENCE TO RELATED APPLICATIONS

This application claims the benefit of U.S. Provisional Application No. 60/055,861, filed Aug. 15, 1997.

FIELD OF THE INVENTION

This invention relates to diamond impregnated drill bits. In one aspect, it relates to diamond impregnated drill bits with areas of differing wear resistance on the face of the bit.

BACK GROUND OF THE INVENTION

Diamond impregnated drill bits are used for boring holes in very hard or abrasive rock formations. The cutting face of such bits contains natural or synthetic diamonds distributed within a supporting material to form an abrasive layer. During operation of the drill bit, diamonds within the abrasive layer are gradually exposed as the supporting material is worn away. The continuous exposure of new diamonds by wear of the supporting material on the cutting face is the fundamental functional principle for impregnated drill bits.

The construction of the abrasive layer is of critical importance to the performance of diamond impregnated drill bits. The abrasive layer typically contains diamonds and/or other super-hard materials distributed within a suitable supporting material. The supporting material must have specifically controlled physical and mechanical properties in order to expose diamonds at the proper rate.

Metal-matrix composites are commonly used for the supporting material because the specific properties can be controlled by modifying the processing or components. The metal-matrix usually combines a hard particulate phase with a ductile metallic phase. The hard phase often consists of tungsten carbide and other refractory or ceramic compounds. Copper or other nonferrous alloys are typically used for the metallic binder phase. Common powder metallurgical methods, such as hot-pressing, sintering, and infiltration are used to form the components of the supporting material into a metal-matrix composite. Specific changes in the quantities of the components and the subsequent processing allow control of the hardness, toughness, erosion and abrasion resistance, and other properties of the matrix.

Proper distribution of fluid used to remove the rock cuttings and cool the exposed diamonds is essential for proper function and performance of diamond impregnated bits. The cutting face typically includes an arrangement of recessed fluid paths intended to promote uniform flow from a central plenum to the periphery of the bit. The fluid paths usually divide the abrasive layer into distinct raised ribs with diamonds exposed on the tops of the ribs. The fluid provides cooling for the exposed diamonds and forms a slurry with the rock cuttings. The slurry must travel across the top of the rib before reentering the fluid paths, which contributes to wear of the supporting material.

The manufacturing process for diamond impregnated bits usually involves placing prefabricated abrasive components and other abrasive or filler materials in a suitable mold. The mold is then infiltrated with an appropriate metal alloy, which binds the abrasive and other materials together. Subsequent finishing operations may include attachment of prefabricated abrasive components or appropriate threaded connections. Several alternative methods, including brazing or welding of prefabricated abrasive components may also be used to construct impregnated drill bits.

SUMMARY OF THE INVENTION

The present invention provides in one aspect, an adaptive matrix diamond impregnated drill bit for boring holes in rock formations that may have significant variations in hardness. The cutting faces of these bits contain an arrangement of different abrasive compositions, which allow adaptation to the different rock types. During operation of these bits, selective wear of specified areas improves the performance of the bit by adjusting diamond exposure to suit the rock formation. The use of different abrasive compositions to establish different diamond exposure in specified areas of the bit face is the primary functional principle for adaptive matrix impregnated drill bits.

The abrasive compositions for adaptive matrix bits contain diamond and/or other super-hard materials distributed within a supporting material. The supporting material may include a particulate phase of tungsten carbide and/or other hard compounds, and a metallic binder phase of copper or other primarily non-ferrous alloys. The properties of the resulting metal-matrix composite material depend on both the percentage of each component and the processing that combines the components. The size and type of the diamonds, carbide particles, binder alloy or other components can also be used to effect changes in the abrasive or erosive wear properties of the abrasive composition.

The primary difference between standard and adaptive matrix bits involves the use of two or more abrasive compositions in specific areas of the bit face. Standard bits sometimes use different abrasive compositions in concentric areas of the bit face. Adaptive matrix bits use two or more different abrasive compositions in alternating ribs or in staggered alternating zones of each rib.

The initial shape of the fluid passages and cutting ribs in the face of adaptive matrix bits is similar to standard impregnated bits. The difference in wear properties of the abrasive composition between alternate ribs or along each rib causes additional exposure of the diamonds in selected areas. The additional exposure or matrix relief in the selected areas increases fluid flow across the tops of the ribs, and provides improved cooling of the diamonds and cleaning of the cuttings. The magnitude of the additional relief or exposure is affected by the differences in the abrasive composition and the properties of the rock formation. The arrangement of different abrasive compositions to form specifically relieved areas within the cutting face is the significant improvement of adaptive matrix bits when compared to standard impregnated bits.

The mold used for construction of adaptive matrix bits is similar to the molds used for standard impregnated bits. Prefabricated blocks of abrasive material are placed in the mold at specified positions. The spaces between the blocks are filled with a different abrasive material, which may be in the form of prefabricated blocks or a moldable abrasive slurry. Several different abrasive compositions in the form of blocks or slurries can be arranged at specific locations in the mold using this general method. The specific combination of prefabricated abrasive components and/or moldable abrasive slurry allows precise construction of the detailed arrangement of different abrasive compositions used in adaptive matrix bits.

Additional discrete cutting elements, such as large natural diamonds or shaped synthetic diamonds can also be added to the cutting structure of the adaptive matrix bits. The added cutting elements may be placed directly in the mold, included within the prefabricated blocks, or attached to the bit after casting.

DETAILED DESCRIPTION OF THE PREFERRED EMBODIMENTS

Figure 1:
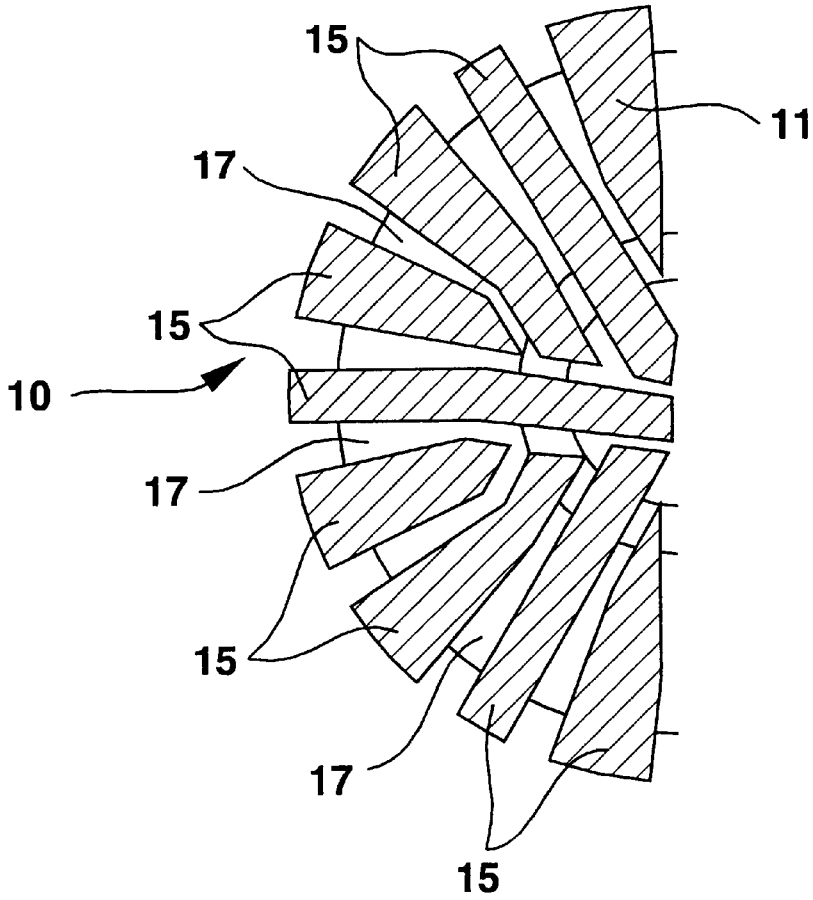
FIG. 1 (Prior Art)
FIG. 1 is a partial end view of the face of a prior art impregnated bit.
Figure 2:
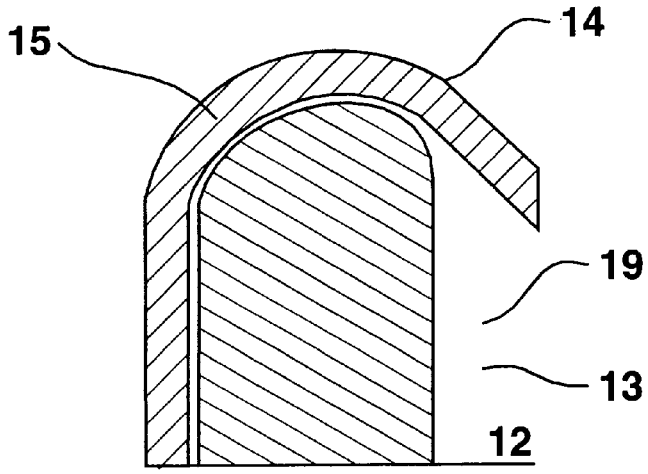
FIG. 2 (Prior Art)
FIG. 2 is a partial sectional side elevational view of the head of a prior art bit.

FIGS. 1 and 2 illustrate partial views of a prior art impregnated bit, generally indicated by arrow 10. In FIG. 1, approximately one half of the circular face 11 is shown, with the other half being approximately the mirror image of the part that is shown. Similarly in FIG. 2, one half of the prior art bit body 13 is illustrated, with the other half, not shown being the mirror image of the part shown.

The bit body 13 is cylindrical in form, with the upper end thereof (not shown) forming a threaded pin which is adapted to be connected to the lower end of a drill string. The lower end of the bit body 13 forms the end face 11. The end face 11 has a plurality of elevated ribs 15 formed thereon, with channels 17 formed between the ribs 15.

The bit body 13 is preferably made of a steel core 12 having an outer shell 14 comprised of a carbide powder matrix material. The ribs 15, are made of a metal-matrix composite. The ribs 15 also have a quantity of synthetic or natural diamonds (not illustrated) embedded within the metal-matrix material. The metal-matrix combines a hard particulate phase with a ductile metallic phase. In the preferred mode, the hard phase consists of tungsten carbide and other refractory or ceramic compounds. Copper or other non-ferrous alloys are typically used for the metallic binder phase. Common powder metallurgical methods, such as hot pressing, sintering and infiltration are used to form the components of the supporting material into a metal-matrix composite. During drilling, as the bit rotates, the bit face 11 contacts the bottom of the borehole, which initially wears away the matrix material on the ribs 15 to expose the diamond particles. The diamond particles then function to wear away the bore hole formation as the bit rotates. The channels 17 function to allow drilling fluid to pass through a central plenum 19 from the interior of the bit body 13 and run along the channels 17 to cool the ribs 15 and to carry the formation cuttings up the annulus formed between the bit and the bore hole.

Figure 3:
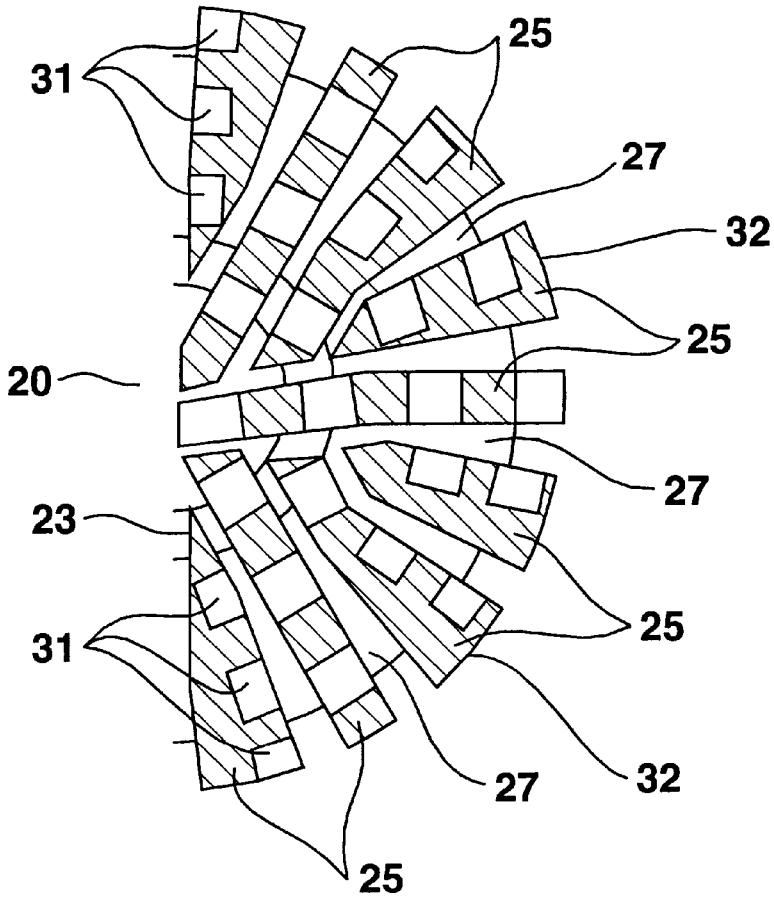
FIG. 3 is a partial end view of the face of an impregnated bit made in accordance with the present invention.
Figure 4:
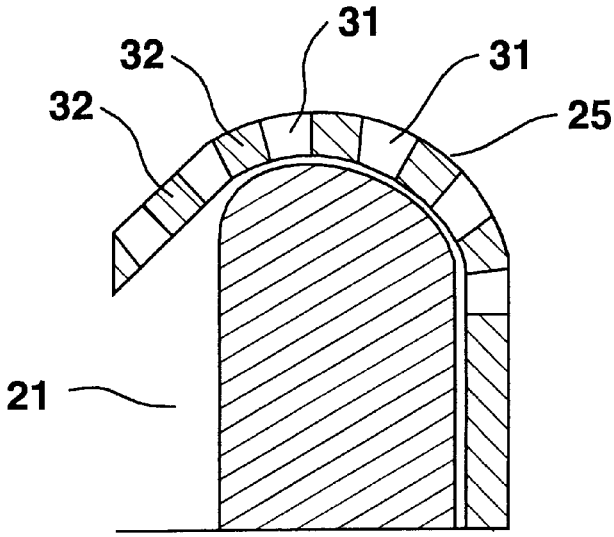
FIG. 4 is a partial sectional side elevational view of the head of an impregnated bit of the present invention.

FIGS. 3 and 4 illustrate a bit, generally indicated by arrow 20, made in accordance with the present invention. The shape of the bit body 21, end face 23, ribs 25 and channels 27 are similar to the construction of the prior art bit shown in FIGS. 1 and 2. The difference in construction is that the ribs 25 include preformed portions 31 and slurry portions 32 made of a different composition than the other. Both compositions, making up ribs 25, include natural diamond or synthetic diamond particles embedded therein.

The composition slurry portion 32 preferably includes a particulate phase of tungsten carbide and/or other hard compounds, and a metallic binder phase of copper or other primarily non-ferrous alloys. The preformed portions 31 are made from the same basic constituents except that the percentages of each component is varied and the processing parameters are changed to form a support material having different properties, including wear properties. The size and type of the diamonds, carbide particles, and binder alloy can also be varied to effect changes in the abrasive or erosive wear properties of the abrasive composition. The information, given below, gives a matrix of the constituents that can be varied with size ranges.

The typical components and volume fractions of those components used in the abrasive composition are listed below:

Diagram 1: Materials

Diamond;
- Natural or Synthetic Origin,
- Sizes from 1 to 1000 stones per carat,
- Fraction from 0.12 to 0.50 of total volume.

Hard Phase;
- Tungsten carbide, chrome carbide (or other refractory compounds),
- Sizes from 1 to 500 micron (typically a distribution of sizes),
- Fraction from 0.0 to 75.0 of total volume.

Ductile Phase;
- Tungsten, cobalt, iron or other metals,
- Sizes from 0.5 to 500 micron,
- Fraction from 0.0 to 0.50 of total volume.

Binder Phase;
- Copper, Zinc, Tin, Manganese, Nickel, (and other metals),
- Size 0.5 micron to 0.5 inch (used for sintering or infiltration),
- Fraction from 0.12 to 0.88 of total volume.

The compositions are adjusted by the following criteria:

Increased fraction of the hard phases causes increased erosion resistance,

Increased hardness of the binder phase causes increased abrasion resistance,

Increased fraction of the ductile, and binder phases reduces wear resistance,

Increased diamond size for softer rock formations.

Diagram 2: Example Compositions

| | Diamond | Hard Phase | Ductile Phase | Binder |
|---|---|---|---|---|
| For Soft Formations; | | | | |
| Composition 1 | 20%, 4 spc | WC, 30% | 0% | 50% |
| Composition 2 | 25%, 20 spc | WC, 50% | 0% | 25% |
| For Medium Formations; | | | | |
| Composition 1 | 25%, 20 spc | WC, 30% | W, 5% | 40% |
| Composition 2 | 30%, 80 spc | WC, 45% | 0% | 25% |
| For Hard Formations; | | | | |
| Composition 1 | 25%, 80 spc | WC, 30% | W, 10% | 35% |

-continued

Diagram 2: Example Compositions

| | Diamond | Hard Phase | Ductile Phase | Binder |
|---|---|---|---|---|
| Composition 2 | 33%, 300 spc | WC, 42% | Co, 5% | 20% |

The abrasive compositions above can be produced by sintering or infiltration. In each of the examples above, Composition 1 will have lower erosion and abrasion resistance than Composition 2. During operation of the adaptive matrix drill bit, the metal matrix will wear more rapidly in the areas containing Composition 1. The increased fluid flow through those areas will improve cooling and cleaning of the cutting structure. Composition 1 includes larger diamonds, which remain effective with the increased exposure in those areas.

The primary advantage to selective use of sintering and infiltration is in the effective separation of abrasive compositions. Prefabricated blocks of abrasive material can be used to form distinctly separated areas of different compositions. The blocks can be placed adjacent to each other, or the areas between can be filled with a different type of block or with different abrasive slurries. The use of relatively few different sizes and shapes of blocks can effectively used to construct the geometry of the cutting face also reduces inventory of components for the adaptive matrix bits.

In this embodiment, the difference in composition allows the portions 31 to wear at a different rate than the slurry portions 32.

In manufacturing the bit face 23 in accordance with the present invention, the portions 31 are preformed and placed in a mold while the composition of the bit body 21 is formed from a thick slurry that is packed into the mold.

Figure 5:
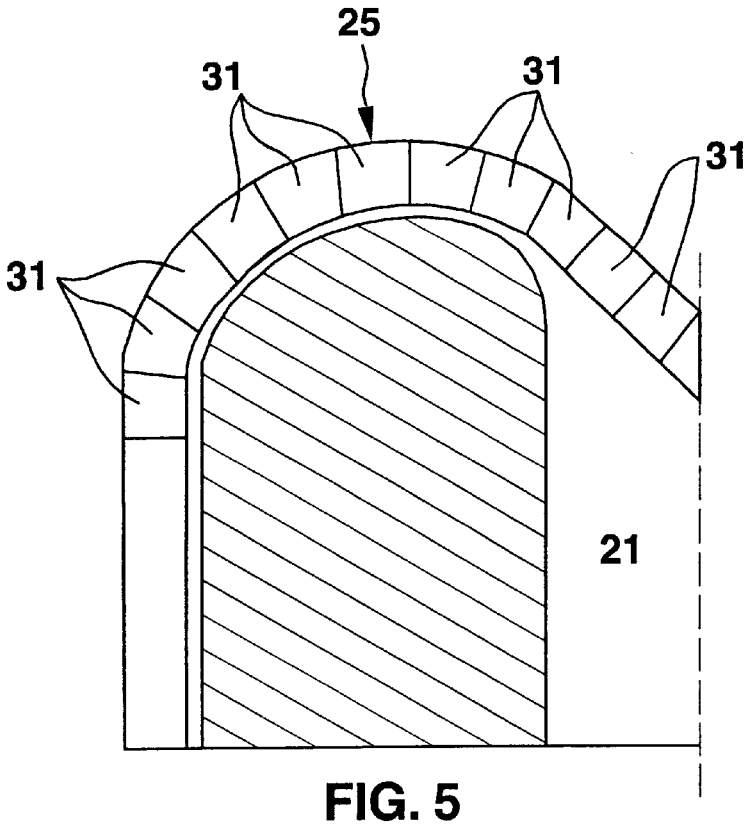
FIGS. 5–10 are partial sectional side elevational views of various embodiments of the present invention.

FIG. 5 illustrates an embodiment in which the entire rib 25 is formed form preformed portions 31, all of which have the same composition. As before, the rest of the bit body 21 is made form a matrix material.

Figure 6:
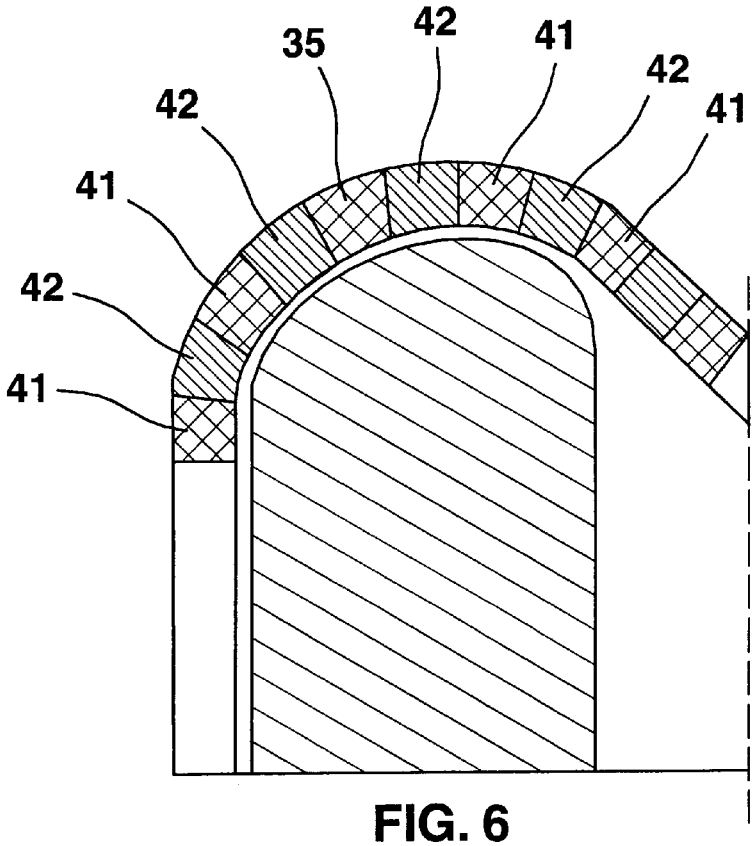

FIG. 6 illustrates an embodiment in which the entire rib 35 is formed from preformed blocks of two different blocks numbered 41 and 42 and interspersed as shown.

Figure 7:
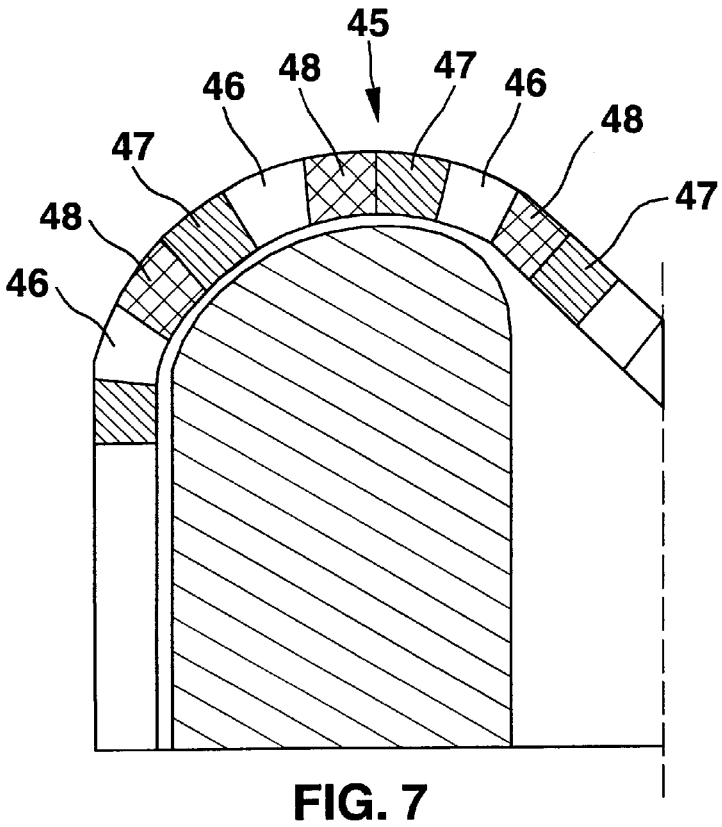

FIG. 7 illustrates an embodiment in which the rib 45 is formed from preformed blocks of two compositions 46 and 47 and a single slurry 48. As mentioned previously, the blocks 46 and 47 are inserted into the mold which forms the ribs, and the slurry 48, which is in the form of paste is packed into the areas of the rib not taken up with the preforms.

Figure 8:
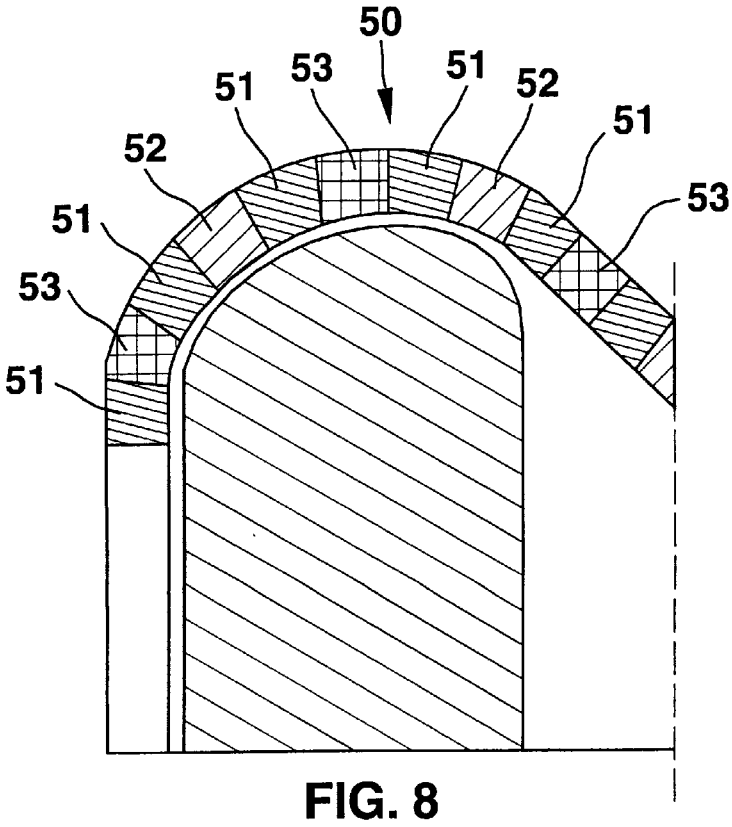

FIG. 8 illustrates an embodiment in which the rib 50 is formed by two preformed blocks 51 and 52 of two different compositions and slurry portions 53 of the same compositions interspersed therebetween.

Figure 9:
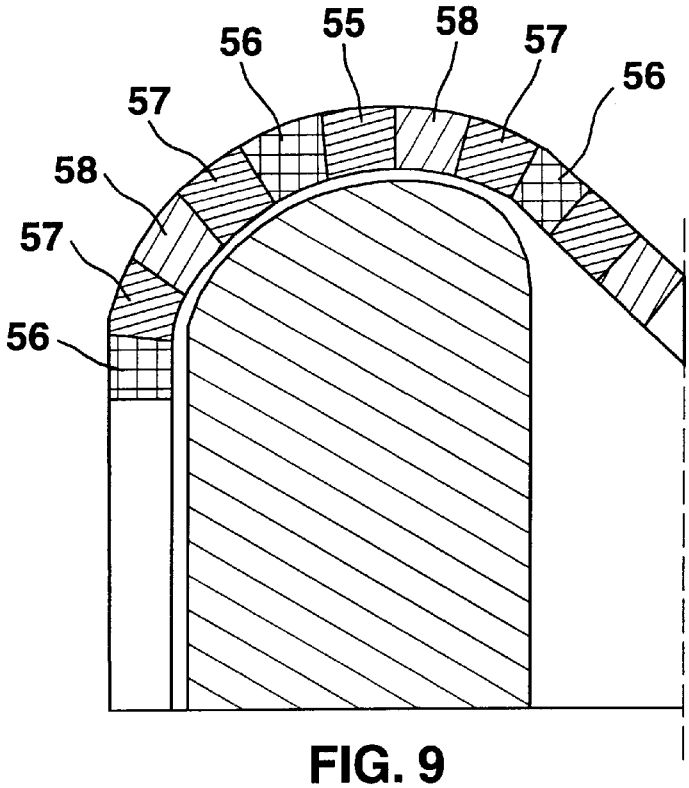

FIG. 9 illustrates and embodiment in which each rib 55 is formed from blocks 57 of the same composition with slurry portions 56 and 58 of two different composition interspersed therethrough as shown.

Figure 10:
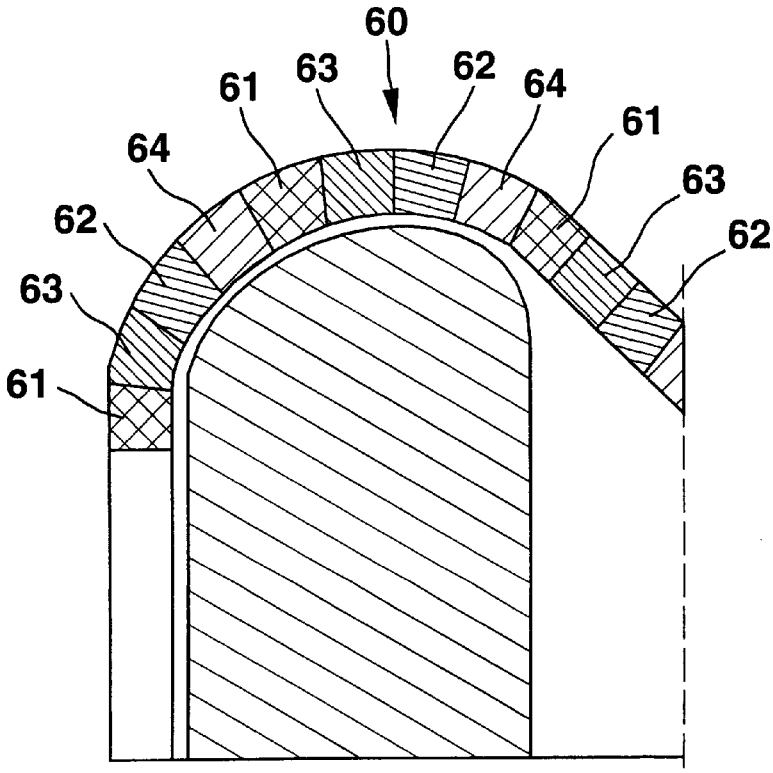

FIG. 10 illustrates an embodiment in which the rib 60 is formed from two sets of blocks 61 and 62 of different compositions located between slurries 63 and 64 of different compositions.

Figure 11:
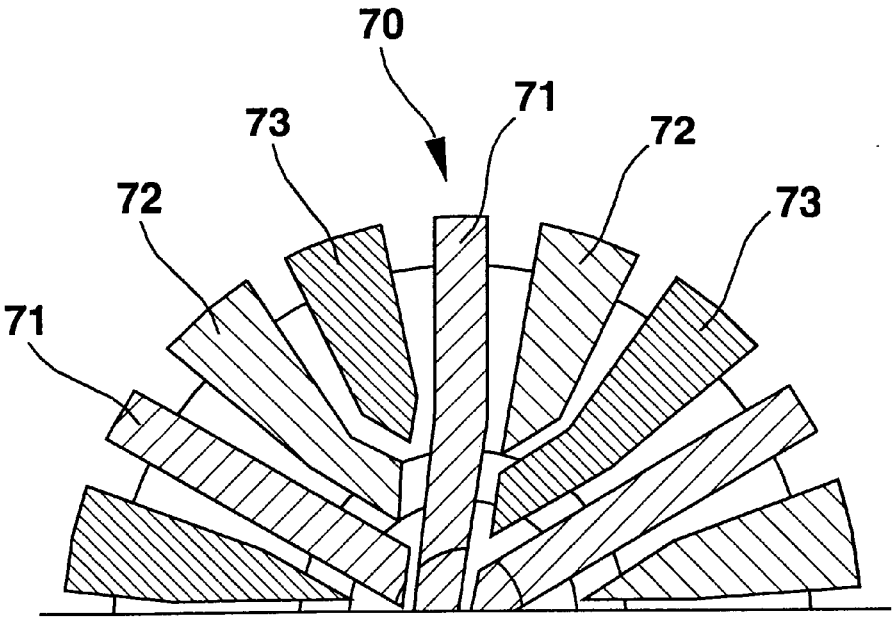
FIGS. 11–16 are partial end views of various embodiments of the present inventions.

FIG. 11 illustrates an embodiment in which the face 70 of the bit includes ribs having different compositions which cover the entire surface of a respective rib. Ribs are shown as 71, 72 and 73 having three compositions which can either be formed from preformed blocks or slurries.

Figure 12:
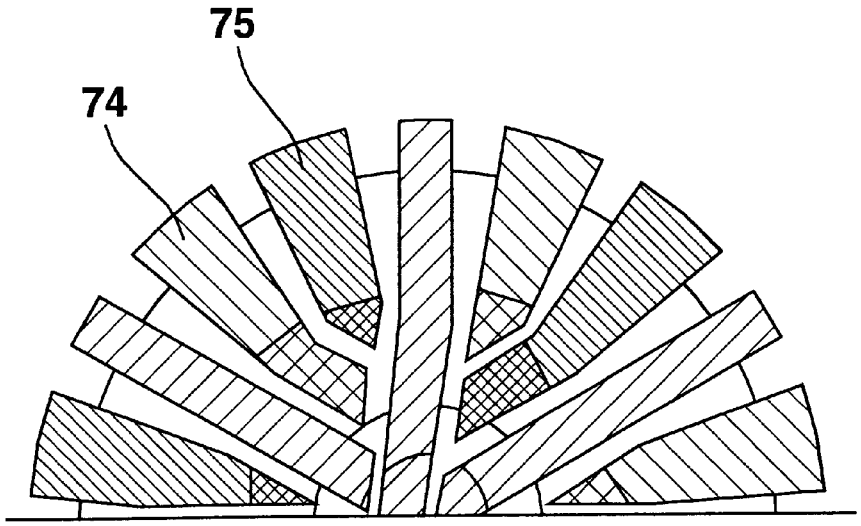

FIG. 12 illustrates an embodiment in which certain ribs 74 and 75 are formed with abrasives of different compositions covering various areas of each rib. Again, each rib can be made from different preform blocks inserted into the rib volumes formed in the die or different slurries that are packed into those volumes.

Figure 13:
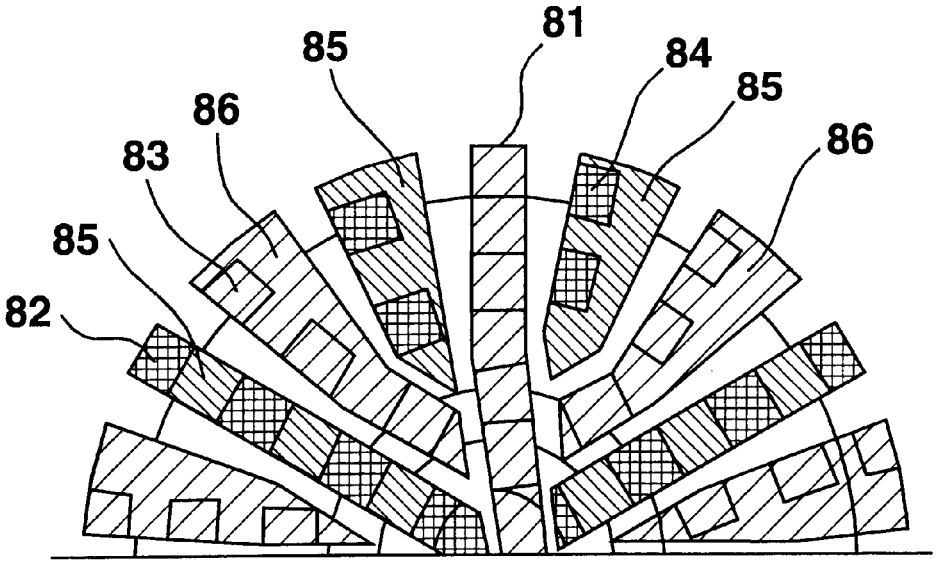

FIG. 13 illustrates a bit face 80 in which each of the ribs 81 and 82 are formed with preformed blocks 83 and 84 surrounded by a slurry 85 and 86 which differ in composition of blocks and slurries of the other rib.

Figure 14:
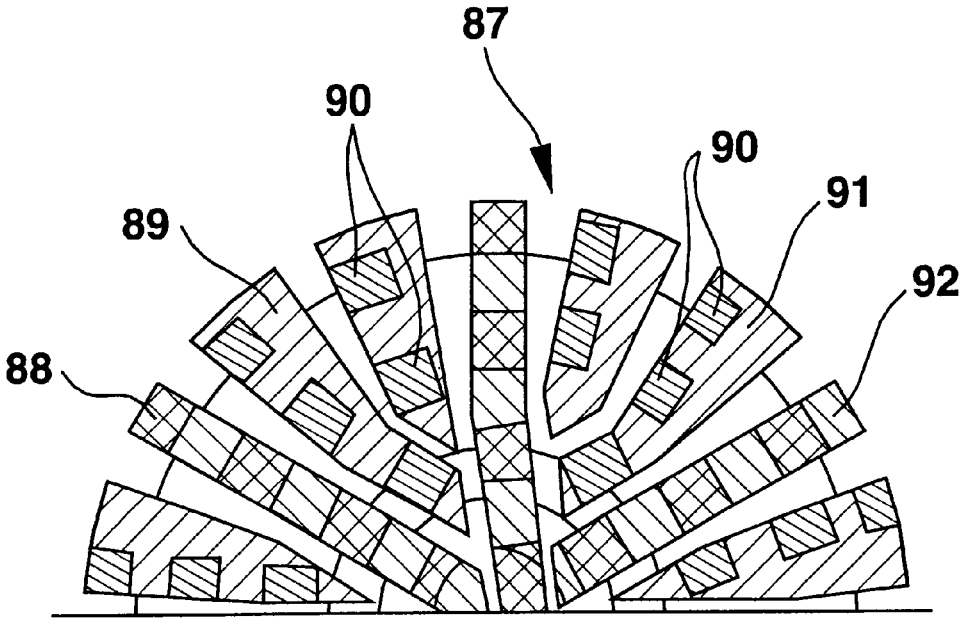

FIG. 14 illustrates a bit face 87 in which each of the ribs 88 and 89 are formed with preformed blocks 90 of the same compositions and slurries 91 and 92 of different compositions for the ribs 88 and 89.

Figure 15:
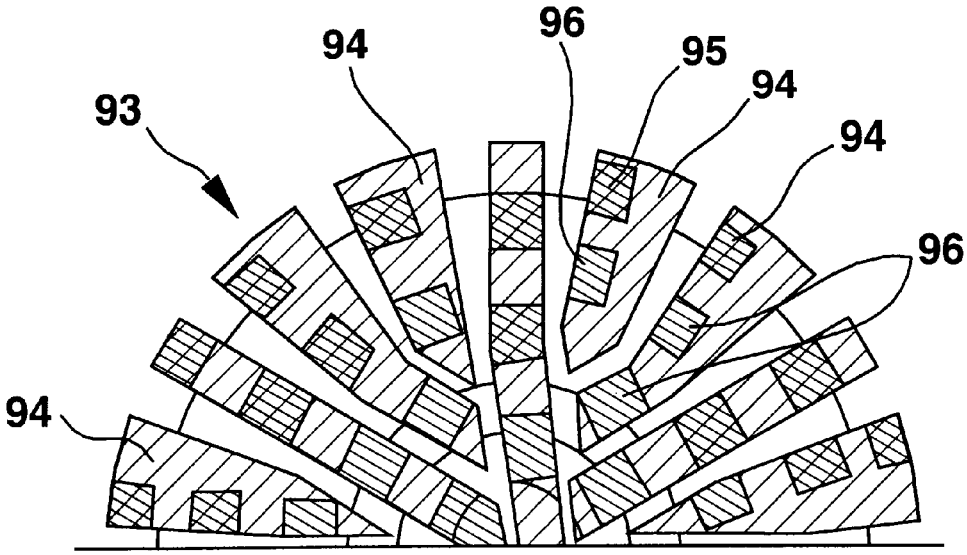

FIG. 15 illustrates a bit face 93 in which each rib is formed with a slurry 94 of similar composition, and preformed blocks 95 and 96 of different composition.

Figure 16:
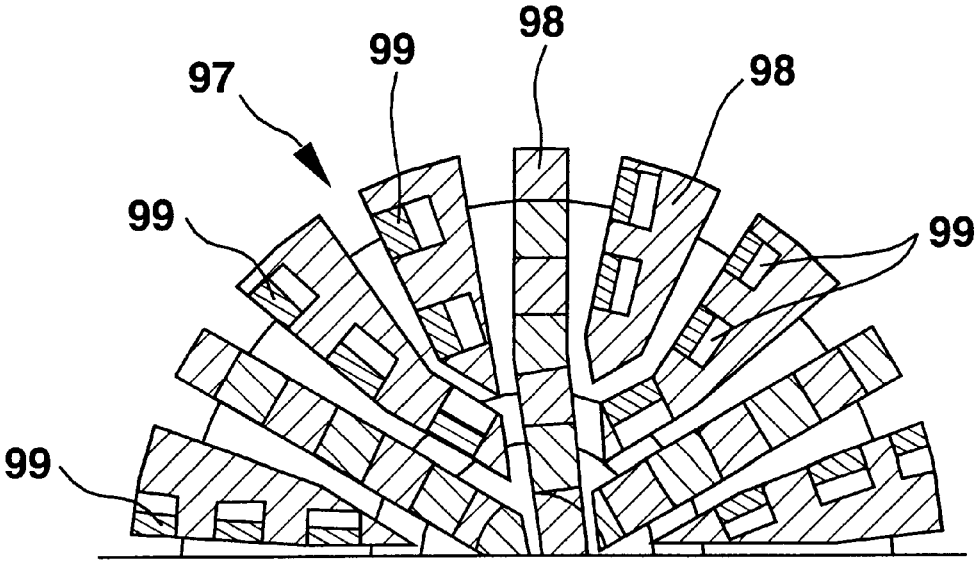

FIG. 16 illustrates a bit face 97 in which some of the ribs are formed with a slurry 98 of similar composition and preformed blocks 99, each of which is formed from two smaller preforms of different compositions.

Figure 17:
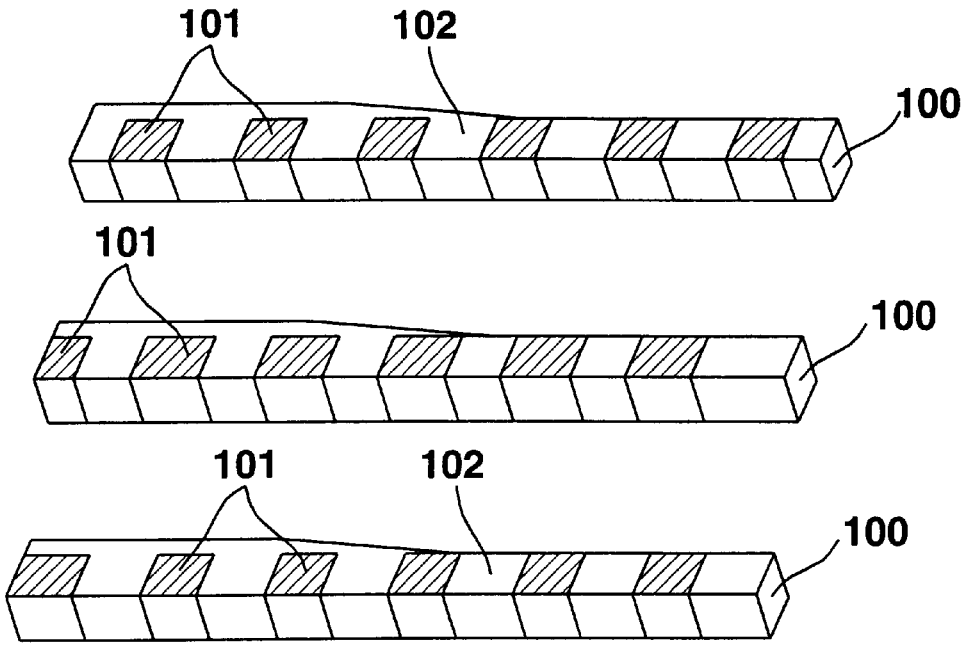
FIGS. 17–20 illustrate various wear patterns on ribs made in accordance with the present invention.

FIGS. 17–20 illustrate some wear patterns that are possible with the present invention. FIG. 17 illustrates a plurality of ribs 100 as manufactured. Each rib 100 is formed with a taper having preformed blocks 101 surrounded by a slurry 102. The ribs are illustrated to show that the preforms are staggered with respect to preforms on the other ribs.

Figure 18:
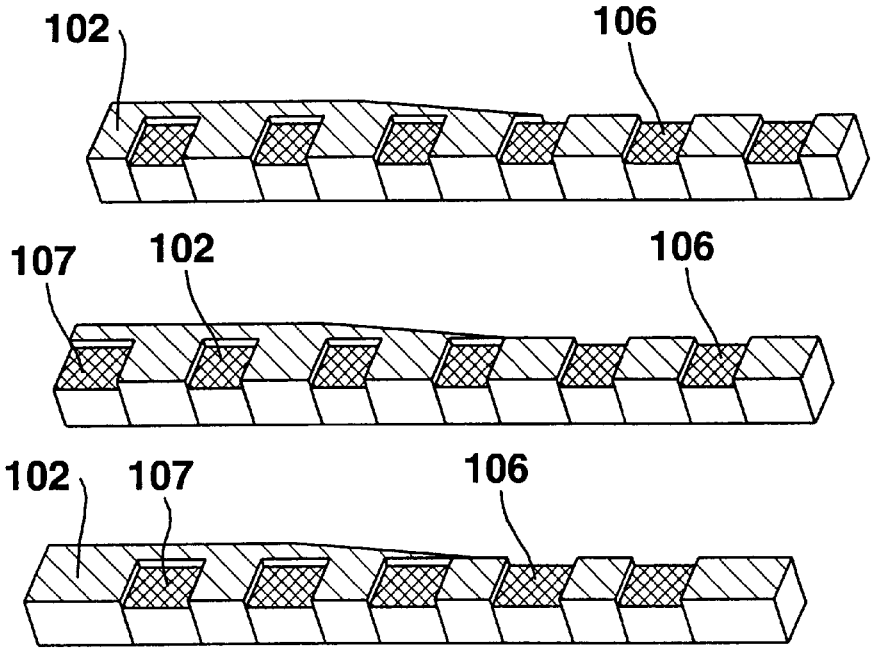

FIG. 18 illustrates the ribs 100 during use. In operation, the preforms 101 are softer in composition than the slurry 102 and as a result wear away faster to form channels to allow fluid to more easily pass over. Some of the channels 106 pass completely through the rib to enable the fluid to cool the rib and carry away the cuttings. Some of the channels 107 pass partially through the rib to create a pressure gradient.

Figure 19:
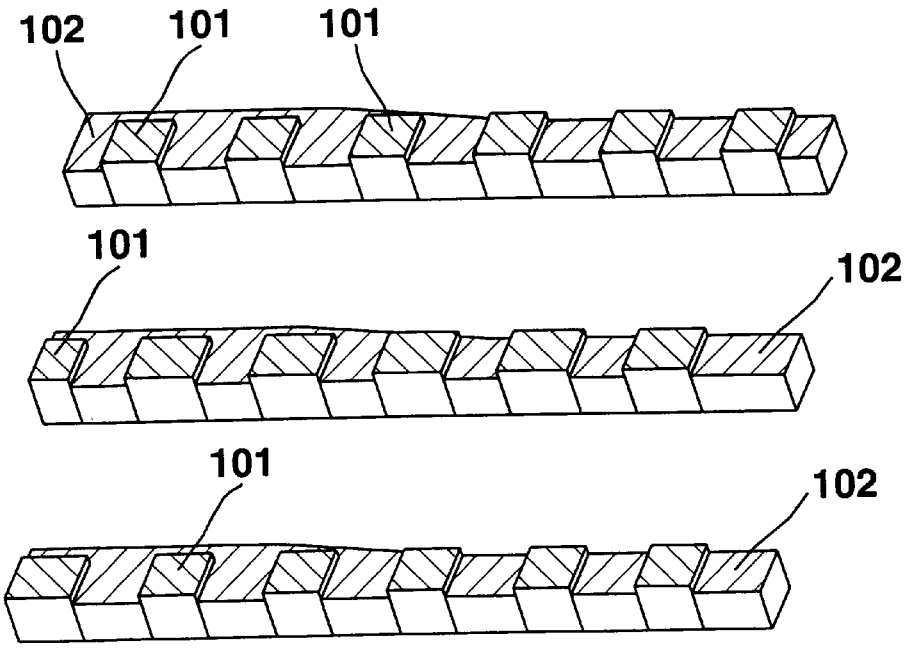

In FIG. 19 the hardness of the preforms 101 and slurry 102 is reversed to show the cavities formed by the faster wearing slurry portions 102.

Figure 20:
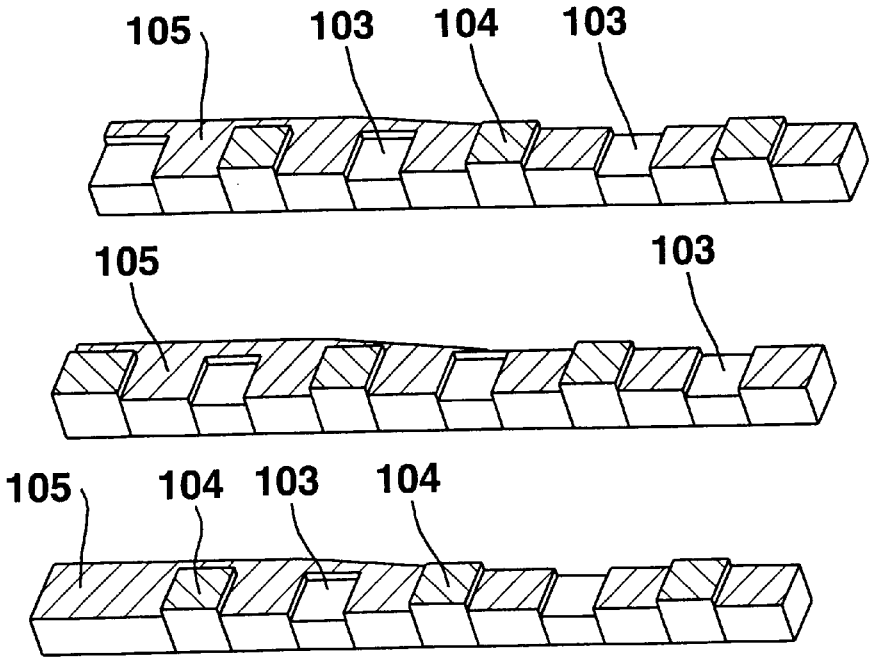

Finally in FIG. 20, still another wear pattern is illustrated in which half of the preforms 103 are of different compositions than the other half of the preforms 104. In addition the preforms 103 are, in turn softer than the slurry 105 while the preforms 104 are harder. As a result, deeper peaks and valleys are formed to create channels for the fluid flow.

While embodiments and applications of this invention have been shown and described, it would be apparent to those skilled in the art that many more modifications are possible without departing from the inventive concepts herein. It's, therefore, to be understood that within the scope of the appended claims, this invention may be practiced otherwise as specifically described.

What is claimed is:

1. A bit for boring into a rock formation, comprising:

(a) a body having a lower end having an end face for engagement with the rock formation, the end face defining a plurality of raised ribs separated by a plurality of channels; and (b) at least one of the plurality of ribs having at least a first area and a second area, the first area comprising a first metal-matrix material impregnated with diamonds or other super-hard materials and the second area comprising a second metal-matrix material impregnated with diamonds or other super-hard materials, the first metal-matrix material being more wear resistant than the second metal-matrix material such that the second metal-matrix material wears faster than the first metal-matrix material during boring into the rock formation.

2. The bit of claim 1 wherein the body has an interior defining a plenum in communication with the channels to allow passage of fluid from the interior of the body into the channels.

3. The bit of claim 1 wherein the first area comprises a first preformed block.

4. The bit of claim 3 wherein the second area comprises a moldable slurry.

5. The bit of claim 3 wherein the second area comprises a second preformed block.

6. The bit of claim 1 wherein the first area comprises a first moldable slurry.

7. The bit of claim 6 wherein the second area comprises a second moldable slurry.

8. The bit of claim 1 wherein the at least one rib has a length from a first end to a second end radially outside of the first end and a width from a first edge to a second edge, and the at least one rib has a series of first areas located along the length of the rib.

9. The bit of claim 8 wherein the rib has a series of second areas located along the length of the rib alternating with the series of first areas.

10. The bit of claim 8 wherein at least one of the series of first areas borders both the first edge and the second edge of the rib.

11. The bit of claim 1 further comprising at least one discrete cutting element mounted in the rib.

12. The bit of claim 11 wherein the discrete cutting element is chosen from the group consisting of large natural diamonds and shaped synthetic diamonds.

13. The bit of claim 1 wherein the diamonds impregnated in the metal-matix material are synthetic diamond particles.

14. The bit of claim 1 wherein a first series of first areas is located on a first one of the plurality of ribs and a second series of first areas is located on a second one of the plurality of ribs with the second series being staggered in a radial direction with respect to the first series.

15. The bit of claim 14 wherein a first series of second areas is located on the first one of the plurality of ribs alternating with the first series of first areas and a second series of second areas is located on the second one of the plurality of ribs alternating with the second series of first areas, the second series of second areas being staggered in a radial direction with respect to the first series of second areas.

16. The bit of claim 1 wherein the at least a first area and the at least a second area are placed in a mold prior to forming of the body in the mold.

* * * * *